US006210289B1

(12) United States Patent
LaBrake

(10) Patent No.: US 6,210,289 B1
(45) Date of Patent: Apr. 3, 2001

(54) GOLF GRIP HAND ALIGNMENT DEVICE IN COMBINATION WITH A GOLF CLUB GRIP

(76) Inventor: James LaBrake, 8568 Benton Ave., Philadelphia, PA (US) 19152

( * ) Notice: Subject to any disclaimer, the term of this patent is extended or adjusted under 35 U.S.C. 154(b) by 0 days.

(21) Appl. No.: 09/438,285

(22) Filed: Nov. 12, 1999

(51) Int. Cl.[7] ..... A63B 53/14
(52) U.S. Cl. ..... 473/201; 473/206
(58) Field of Search ..... 473/201–206, 473/300–303

(56) References Cited

U.S. PATENT DOCUMENTS 1,638,454 * 8/1927 Papin .
2,780,464 * 2/1957 Ashley .

FOREIGN PATENT DOCUMENTS

156538 * 5/1954 (AU) .
17338 * 8/1910 (GB) .

* cited by examiner

*Primary Examiner*—Jeanette Chapman
*Assistant Examiner*—Stephen L. Blau
(74) *Attorney, Agent, or Firm*—Gregory J. Gore

(57) ABSTRACT

A golf club grip alignment device is provided by a rib of material laying along the surface of the golf club grip. The side edges of the rib guide the golfer's hands into proper alignment. The rib may be formed by a continuous metal wire which wraps around the surface of the golf club grip, in which case the rib is held to the golf club grip by means of the torsional spring resilience of the wire. In an alternate embodiment, the rib may be composed of a flaccid material whose position and affixation to the grip is provided by a highly elastic sleeve into which it is embedded. The sleeve is applied to the golf club grip as a pull-over cover which holds itself firmly in position by the elastic constriction of the sleeve.

6 Claims, 3 Drawing Sheets

GOLF GRIP HAND ALIGNMENT DEVICE IN COMBINATION WITH A GOLF CLUB GRIP

FIELD OF THE INVENTION

This invention pertains to a golf grip hand alignment device. More specifically, it pertains to a hand alignment structure that may be applied as an overlay to a standard golf club grip.

DESCRIPTION OF THE PRIOR ART

Various golf club teaching aids and other devices have been used to help the golfer position his hands on the golf club grip properly. Correct hand position is known to be an important element in executing a golf shot properly. Prior hand alignment devices include special grips provided as replacements for standard golf club grips. While these grips may be effective in ensuring proper hand alignment, it is expensive to re-grip an entire set of golf clubs. This expense is doubled when one wishes to convert their set of golf clubs back to standard grips from the hand alignment training grips.

An example of prior art hand alignment golf club grip is that disclosed in U.S. Pat. No. 5,480,146 issued to Comer on Jan. 2, 1996. Other patent prior art of which the applicant is aware includes the following: U.S. Pat. No. D395,477, entitled Golf Grip, issued on Jun. 23, 1998; U.S. Pat. No. 4,012,039, entitled Permanent Form-Fitting, Non-Slip Cover For Handgripping Portion Of Baseball Bats, Golf Clubs And The Like, issued on Mar. 15, 1977; U.S. Pat. No. D399,90, entitled Golf Putter Grip, issued on Oct. 20, 1998; U.S. Pat. No. 5,868,631, entitled Golf Putter With Improved Handle, issued on Feb. 9, 1999; U.S. Pat. No. 5,830,081, entitled Golf Putters And Grips For Putters, issued on Nov. 3, 1998; U.S. Pat. No. 5,374,064, entitled Golf Club Training Apparatus, issued on Dec. 20, 1994; U.S. Pat. No. 5,167,416, entitled Golf Club With Perceptor Device, issued on Dec. 1, 1992; U.S. Pat. No. 5,143,375, entitled Golf Club Finger Support Device, issued on Sep. 1, 1992; U.S. Pat. No. 5,125,130, entitled Ergonomic Handle For Tools And Sporting Equipment, issued on Jun. 30 1992; U.S. Pat. No. 4,183,528, entitled Natural Physiological Grip For Game Rackets, issued on Jan. 15, 1980.

However, none of these references teach a simple means of ensuring proper golf grip hand alignment which is inexpensive, easily adaptable to an existing golf club, and readily removable without adversely effecting the golf club as originally gripped. There is, therefore, a need in art to fulfill these objectives.

SUMMARY OF THE INVENTION

In order to fulfill the needs in the art described above, the present invention has been devised that applies a rib of material along the outside of a standard golf club grip which guides the golfer's hands into proper alignment. The means of applying the rib may take various forms such as shown in the embodiments described herein, however, in each case the alignment rib is easily applied and removed, thus, saving the expense of re-gripping the golf clubs to achieve a hand aligning golf club grip.

In one embodiment, the alignment rib is in the form of a continuous metal wire which wraps around the surface of the golf club grip. The wire has a shape and sufficient resilience such that it readily clutches itself firmly to the golf club grip material by means of its torsional spring force. Being a continuous piece of resilient metal wire, it is extremely inexpensive to manufacture. In another embodiment, the rib may be a flaccid material whose position and affixation to the golf club grip is provided by a highly elastic sleeve into which it is embedded. The sleeve is applied to the golf grip as a pull-on cover which holds itself firmly to the golf club grip by the elastic constriction of the sleeve.

In either embodiment the objects of the present invention have been achieved whereby a hand alignment device for a golf club grip provides economy of manufacture, ease of use, and may be applied and removed to a standard golf club grip without affecting it. The present invention also provides a much more comfortable grip for the golfer. Greater detail of the present invention and other of its advantages will be apparent from the following drawings and description of the preferred embodiment.

DESCRIPTION OF THE PREFERRED EMBODIMENT

Figure 1:
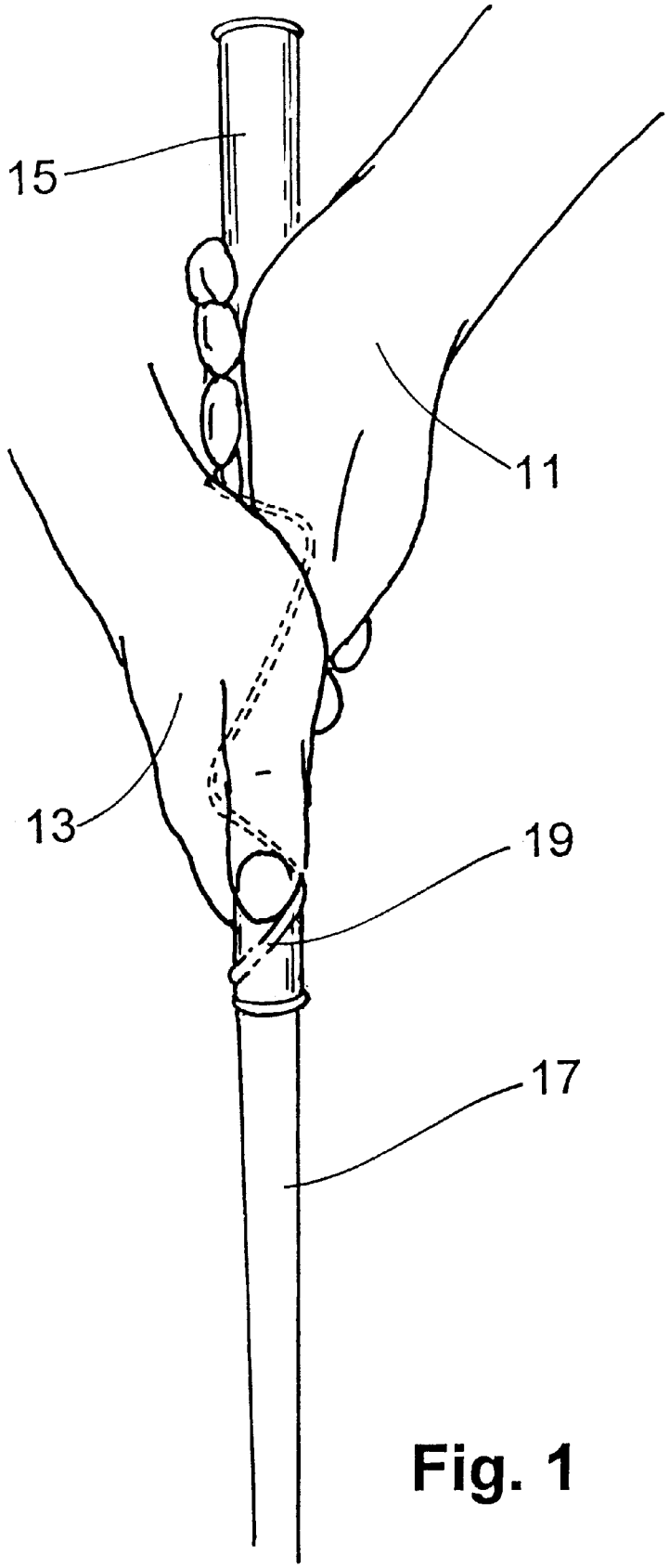
FIG. 1 is a front view of the present invention showing the golfer's hand positioned in alignment with the device of the present invention.
Figure 4:
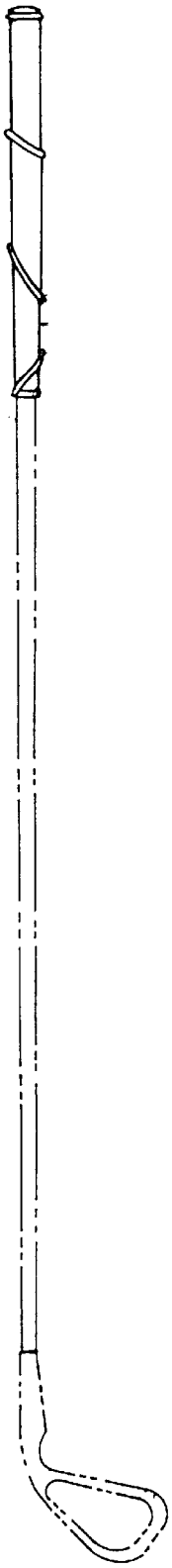
FIG. 4 is a left-side view of a golf club showing the present invention applied thereto.
Figure 2:
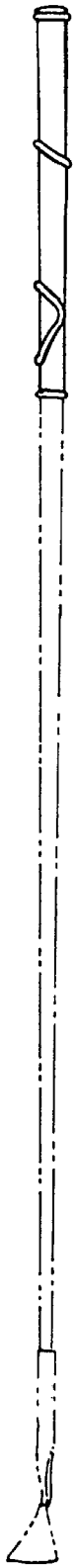
FIG. 2 is a front view of a golf club with the present invention applied thereto.
Figure 3:
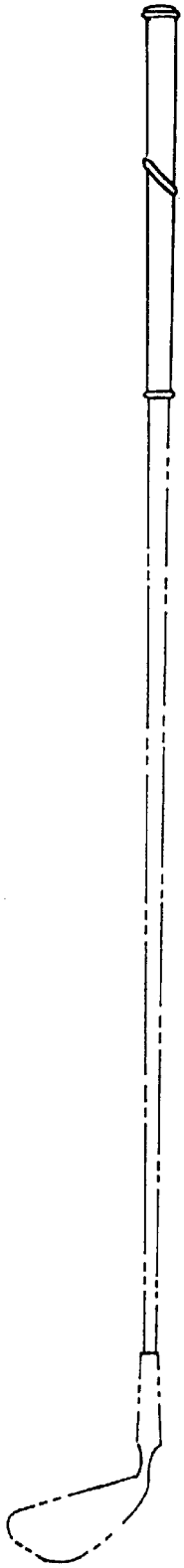
FIG. 3 is a right-side view of a golf club showing the present invention applied thereto.
Figure 5:
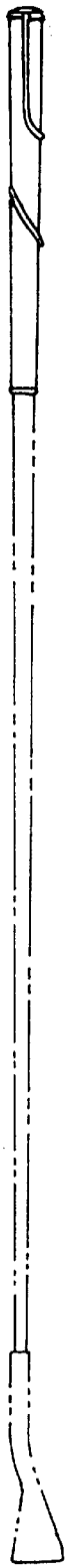
FIG. 5 is a rear view of a golf club showing the present invention applied thereto.

Referring now to FIG. 1, the present invention is shown applied to a golf grip with the hands of the golfer guided into proper alignment by the side edges of the rib of material of the present invention. It can be seen from this view the golfer's left hand 11 and right hand 13 are placed on the golf grip 15 of club 17. Affixed to the grip is the rib alignment device 19 of the present invention which wraps around the grip. As previously described, the alignment rib is preferably a resilient metal spring material which is wrapped around the golf grip 15 and clutches itself thereto by its resilient torsional spring force. As shown in this figure, the thumbs of the hands of the golfer rest against the sides of alignment rib 19 which guide the hand on the club into a desired position. The particular orientation of the present invention shown in this figure is to be exemplary only and it should be understood to one of ordinary skill in the art, that a particular contour of the rib may be chosen to guide the golfer's hands into different desired positions. Also, the same contour may be applied to the golf grip at different radial positions to shift the position of the club shaft while maintaining the same hand position, as more clearly shown in FIG. 6. Thus, a particular contour i.e., shape and the path of the rib along the grip, as shown is intended to be exemplary only.

Referring now to FIGS. 2–5, the present invention is shown in different views of the golf club in order to depict the preferred rib configuration and to show its location along the golf club grip from different points of view. Although, it is shown in these figures, it is applied to a golf "iron" it may be applied to all of the clubs including the "woods" and putter.

Figure 6:
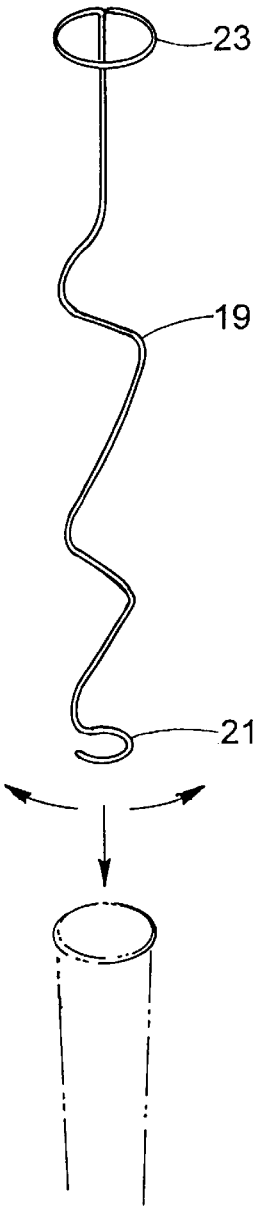
FIG. 6 shows the wire embodiment of the present invention as depicted in FIGS. 1–5 in isolation with arrows indicating that it may be applied to a golf club in different radial positions.

Referring now to FIG. 6, greater detail of the present invention is shown, as depicted in this figure, the spring may be applied to a golf club grip oriented radially as desired. The spring 19 includes bottom hook 21 and top loop 23. Immediate portions of the rib are formed into a substantially helical coil which clutches itself to the golf club grip because of its torsional spring force created by the resilient nature of the material.

Figure 7:
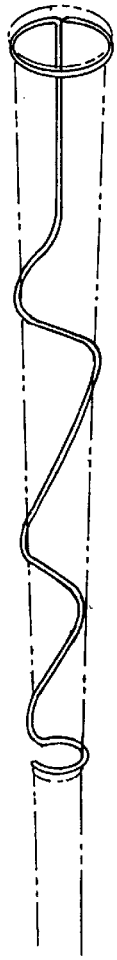
FIG. 7 is a top-front isometric view which shows the entire length of the present invention as applied to a standard golf club grip with the club and grip shown in phantom.

Referring to FIG. 7, the present invention is shown the embodiment in FIG. 6 positioned around the golf club grip after it is applied with the grip and club shaft shown in phantom. The hook 21 at the bottom end of the rib secures its axial location around the club shaft at the base of the grip. The top loop 23 provides a stop at the end of the club which prevents the club from slipping out of the golfer's grasp, thus, promoting the desired loose hold on the club.

Figure 9:
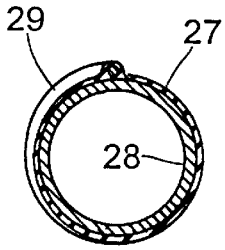
FIG. 9 is a plan sectional view taken from FIG. 8 as shown in that figure.
Figure 8:
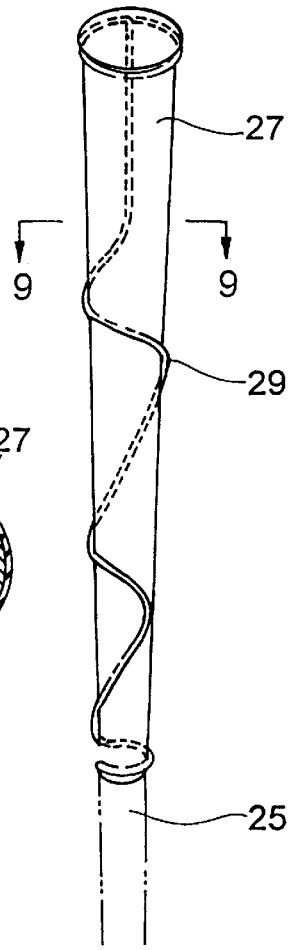
FIG. 8 is a top-front isometric view of a second embodiment of the present invention where the alignment rib is embedded in an elastomeric sleeve.

Referring now to FIGS. 8 and 9, an alternate embodiment of the present invention is shown. In this embodiment the alignment rib is formed by a flaccid material which is flexible such as cordage or an elastomeric strand that is embedded into an elastomeric sleeve. In FIG. 8, the club 25 is shown in phantom and elastomeric sleeve 27 is pulled over the standard golf club grip. The hand alignment rib 29 is held in position according to its fixed position within the sleeve being embedded therein at all points along its length. The alignment rib is held firmly to the golf club grip not by the resilient nature of its material as shown the preferred embodiment, but rather by the elastic constriction of the sleeve around the golf club grip. As a further advantage of the present invention the embodiment greatly adds to the comfort the golfer feels when using golf club grips, which the present invention has been fitted. This is particularly evident in the case of the embodiment which utilizes the pull-over elastomeric sleeve that adds both texture and compressibility with standard golf club grips. FIG. 9 shows the sleeve 27 holding the alignment rib 29 against the golf club grip 28. Rib 29 is clearly shown embedded into the sleeve. As with the previous embodiment, this form of the invention may be easily applied and removed from a standard golf club grip easily and without any lasting effect and thus, the objects of the invention have been achieved.

It should be understood that there may be other methods of securing alignment rib of the present invention to the golf club grip that will be obvious to those of ordinary skill in the art from the teachings disclosed herein. Furthermore, the particular embodiment disclosed is configured for a right handed golfer and should be evident that left handed golfer's position of the alignment rib should be reversed. The scope of the invention should be limited only by the following claims and their legal equivalents.

What is claimed is:

1. A golf club grip hand-alignment device in combination with a golf club grip, comprising;

a golf club grip;

a device having only one continuous strand of material forming a rib having side edges, said rib affixed to an outer surface of said grip;

said device having said side edges of said rib positioned along points of said surface of said grip located to contact hands of the user when they are placed in a desired position;

said device having said strand wrapping around said grip and being firmly held thereto only by the spring force of the strand; and said device having said strand having ends which are not fixed to any other point along said strand.

2. The golf club grip hand-alignment device in combination with the golf club grip of claim 1 wherein said strand of material is composed of spring steel.

3. A golf club grip hand-alignment device in combination with the golf club grip of claim 1 further including a bottom portion which encircles a base of said grip.

4. A golf club grip hand-alignment device in combination with the golf club grip of claim 3 wherein said strand includes a top loop portion encircling a top end of said grip for securement of said strand to said grip and for providing a stop to prevent the club from slipping out of the user's grasp.

5. A golf club grip hand-alignment device in combination with the golf club grip of claim 1 wherein said strand is embedded in an elastomeric sleeve.

6. A golf club grip hand-alignment device in combination with the golf club grip of claim 5 wherein said strand is composed of a flaccid material held firmly in position against said golf club grip by the resilient constriction of said sleeve about said grip.

* * * * *